US010352573B2

(12) United States Patent
Hatakeyama et al.

(10) Patent No.: US 10,352,573 B2
(45) Date of Patent: Jul. 16, 2019

(54) AIR-CONDITIONING APPARATUS HAVING DECORATIVE PANEL MOUNT STRUCTURE AND INDOOR UNIT HAVING THE SAME

(71) Applicant: Mitsubishi Electric Corporation, Tokyo (JP)

(72) Inventors: Hiroyuki Hatakeyama, Tokyo (JP); Masaaki Maruyama, Tokyo (JP); Takaaki Takishita, Tokyo (JP); Naoya Matsunaga, Tokyo (JP); Tatsuo Furuta, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 124 days.

(21) Appl. No.: 14/894,657

(22) PCT Filed: Jul. 23, 2014

(86) PCT No.: PCT/JP2014/069493
§ 371 (c)(1),
(2) Date: Nov. 30, 2015

(87) PCT Pub. No.: WO2015/019853
PCT Pub. Date: Feb. 12, 2015

(65) Prior Publication Data

US 2016/0123606 A1 May 5, 2016

(30) Foreign Application Priority Data

Aug. 7, 2013 (JP) ..... 2013-164347

(51) Int. Cl.
*F24F 1/02* (2019.01)
*F24F 1/027* (2019.01)
(Continued)

(52) U.S. Cl.
CPC ..... *F24F 1/027* (2013.01); *F24F 1/0007* (2013.01); *F24F 1/0047* (2019.02); *F24F 13/20* (2013.01);
(Continued)

(58) Field of Classification Search
CPC ..... F24F 1/0007; F24F 13/20; F24F 13/32; F24F 2001/0037; F24F 2013/202; F24F 2221/26; F24F 1/027
(Continued)

(56) References Cited

U.S. PATENT DOCUMENTS

2005/0042057 A1* 2/2005 Konig ..... F16B 37/043 411/103
2007/0044787 A1* 3/2007 Brice ..... A01K 1/0058 126/91 A

FOREIGN PATENT DOCUMENTS

| | | | | |
|---|---|---|---|---|
| CN | 202852505 U | | 4/2013 | |
| EP | 2390515 | * | 11/2011 | ..... F16B 37/02 |
| JP | S64-53819 U | | 4/1989 | |
| JP | H04-288421 A | | 10/1992 | |
| JP | H05-187657 A | | 7/1993 | |

(Continued)

OTHER PUBLICATIONS

Sakashita, Akihiko, JPH07332697 Translation.pdf, "Decorative panel mounting structure of air-conditioner", Dec. 1995, pp. 1-14.*

(Continued)

*Primary Examiner* — Vivek K Shirsat
*Assistant Examiner* — Ryan L Faulkner
(74) *Attorney, Agent, or Firm* — Posz Law Group, PLC

(57) ABSTRACT

A mount unit for mounting a decorative panel on an underside of an air-conditioning apparatus main body includes a decorative panel mount fitting having a screw engagement hole that communicates with the screw insertion hole of the decorative panel and a claw that is fitted into the claw
(Continued)

engagement hole formed on each side of the screw insertion hole of the decorative panel and a decorative panel mount screw, and is configured to be held by the decorative panel without being dropped off when the claw is fitted into the claw engagement hole and the decorative panel mount screw is engaged with the screw engagement hole with a head being oriented downward, and the decorative panel is mounted on the air-conditioning apparatus main body when the decorative panel mount screw held on the decorative panel is screwed into the screw fastening hole of the air-conditioning apparatus main body via the screw insertion hole.

14 Claims, 5 Drawing Sheets

(51) Int. Cl.

| | |
|---|---|
| ***F24F 13/20*** | (2006.01) |
| ***F24F 13/32*** | (2006.01) |
| ***F24F 1/0007*** | (2019.01) |
| ***F24F 1/0047*** | (2019.01) |

(52) U.S. Cl.
CPC ..... *F24F 13/32* (2013.01); *F24F 2013/202* (2013.01); *F24F 2221/26* (2013.01)

(58) Field of Classification Search
USPC ..... 454/296
See application file for complete search history.

(56) References Cited

FOREIGN PATENT DOCUMENTS

| | | | |
|---|---|---|---|
| JP | H06-159723 | A | 6/1994 |
| JP | H07-332697 | A | 12/1995 |
| JP | H08-091115 | A | 4/1996 |
| JP | 2007-010222 | A | 1/2007 |
| JP | 2011-247295 | A | 12/2011 |
| WO | 03/048591 | A1 | 6/2003 |

OTHER PUBLICATIONS

Matsumoto, Toru, JPH04288421 Tanslation.pdf, "Mounting plate for fancy panel of ceiling-embedded air conditioner", Oct. 1992, pp. 1-9.*
Hashimoto, Tatsuo, JPH8091115 Translation.pdf, "Temporary holding structure for lamp", Apr. 1996, pp. 1-5.*
Extended European Search Report dated May 15, 2017 issued in corresponding EP application No. 14833954.2.
Office Action dated Feb. 27, 2017 for the corresponding CN application No. 201410383912.1 (and English translation).
International Search Report of the International Searching Authority dated Oct. 28, 2014 for the corresponding International application No. PCT/JP2014/069493 (and English translation).
Office Action dated Sep. 2, 2016 for the corresponding CN application No. 201410383912.1 (and English translation).
Examination Report dated Oct. 30, 2018 in the corresponding Indian Patent Application No. 201647006233.

* cited by examiner

AIR-CONDITIONING APPARATUS HAVING DECORATIVE PANEL MOUNT STRUCTURE AND INDOOR UNIT HAVING THE SAME

CROSS REFERENCE TO RELATED APPLICATIONS

This application is a U.S. national stage application of International Application No. PCT/JP2014/069493 filed on Jul. 23, 2014, is based on Japanese Patent Application No. 2013-164347 filed on Aug. 7, 2013, the disclosures of which are incorporated herein by reference.

TECHNICAL FIELD

The present invention relates to a decorative panel mount structure of an air-conditioning apparatus and an indoor unit having the same.

BACKGROUND ART

Conventionally, a decorative panel mount screw is used to mount a decorative panel on an air-conditioning apparatus main body which is held by hanging in a space above a ceiling. In general, since the decorative panel mount screw is separately packed from the decorative panel and the air-conditioning apparatus main body when it is shipped, there has been a problem that a screw may be lost at the site and the decorative panel may not be appropriately mounted. Further, even if a screw is not lost, an operator needs to perform a mounting operation at a high place while holding a screw with his/her hand after the decorative panel is temporarily hung on the air-conditioning apparatus main body. If an operator inadvertently drops off the decorative panel mount screw during working at a high place, he/she needs to climb up and down a stepladder. Accordingly, improvement in the mount structure has been needed.

There is a conventional structure in which a mount unit which includes a decorative panel mount screw is pre-mounted on a decorative panel itself and the decorative panel mount screw is not removed from the decorative panel so that the decorative panel mount screw does not need to be held by hand during a mounting operation (for example, see Patent Literature 1). This mount unit includes a temporarily hanging fitting which is temporarily hung on a hook formed on the outer surface of the air-conditioning apparatus main body, a connection plate fixed to the temporarily hanging fitting, and a decorative panel mount screw which is advanced and retracted in a direction perpendicular to the connection plate by a screwing operation.

In mounting of the decorative panel, the temporarily hanging fitting is temporarily hung on the hook. In this state, the decorative panel mount screw is screwed so as to displace the decorative panel mount screw with respect to the connection plate, and accordingly, the decorative panel supported by a head of the screw via a support panel is upwardly moved and is mounted at a predetermined position.

CITATION LIST

Patent Literature

Patent Literature 1: Japanese Unexamined Patent Application Publication No. 7-332697 ([0037], FIG. 2)

SUMMARY OF INVENTION

Technical Problem

The mount unit shown in Patent Literature 1 includes the temporarily hanging fitting, the connection plate, the decorative panel mount screw, and also a nut and the like for assembling the decorative panel mount screw so as not to be removed. This causes a complicated structure due to a large number of parts and increase in cost. Further, in the mount structure of Patent Literature 1, although a work efficiency during mounting of the decorative panel is expected to be improved by preventing drop off of the decorative panel mount screw, an assembly workability during mounting of the mount unit itself to the decorative panel may be compromised since the mount unit itself has a large number of parts. Accordingly, improvement of mount structure is still needed.

The present invention has been made to solve the above problem, and an object of the present invention is to provide a decorative panel mount structure of an air-conditioning apparatus which can achieve a simplified structure and cost reduction with reduced number of parts of the mount unit while keeping the efficiency of a mount operation of the decorative panel, and provides an indoor unit having the same.

Solution to Problem

A decorative panel mount structure of an air-conditioning apparatus according to the present invention is a decorative panel mount structure of an air-conditioning apparatus for mounting a decorative panel on an underside of an air-conditioning apparatus main body which has an opening on the underside by using a mount unit, wherein the decorative panel includes a screw insertion hole and claw engagement holes each formed on each of the both sides of the screw insertion hole, the mount unit is disposed on the underside of the decorative panel when used, and includes a decorative panel mount fitting having a screw engagement hole that communicates with the screw insertion hole and a claw that is fitted into the claw engagement hole and a decorative panel mount screw, and is configured to be held by the decorative panel without being dropped off when the claw of the decorative panel mount fitting is fitted into the claw engagement hole of the decorative panel and the decorative panel mount screw is engaged with the screw engagement hole of the decorative panel mount fitting with a head being oriented downward, and the decorative panel is mounted on the air-conditioning apparatus main body when the decorative panel mount screw held on the decorative panel by the decorative panel mount fitting is screwed into the screw fastening hole of the air-conditioning apparatus main body via the screw insertion hole of the decorative panel.

Advantageous Effects of Invention

According to the present invention, since the mount unit for mounting the decorative panel on the air-conditioning apparatus main body has a two-part structure composed of the decorative panel mount screw and the decorative panel mount fitting which has the screw engagement hole that holds the decorative panel mount screw with the head oriented downward and the claw which is fitted into the claw engagement hole of the decorative panel is formed on the decorative panel mount fitting so as to prevent the decorative panel mount fitting from being dropped off from the decorative panel, the mount unit can be held on the decorative panel. Accordingly, a simplified structure and cost reduction can be achieved with reduced number of parts of the mount unit, while keeping the efficiency of a mount operation of the decorative panel.

DESCRIPTION OF EMBODIMENTS

Embodiment 1

Figure 1:
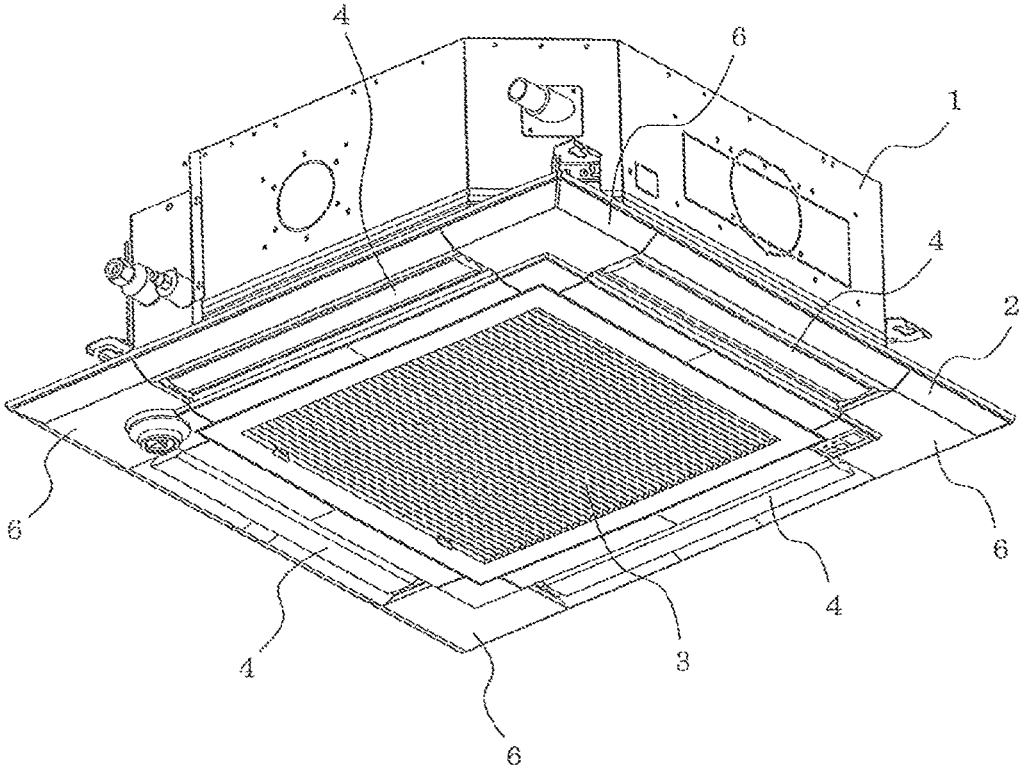
FIG. 1 is an appearance perspective view of an air-conditioning apparatus (indoor unit) according to Embodiment 1 of the present invention.
Figure 2:
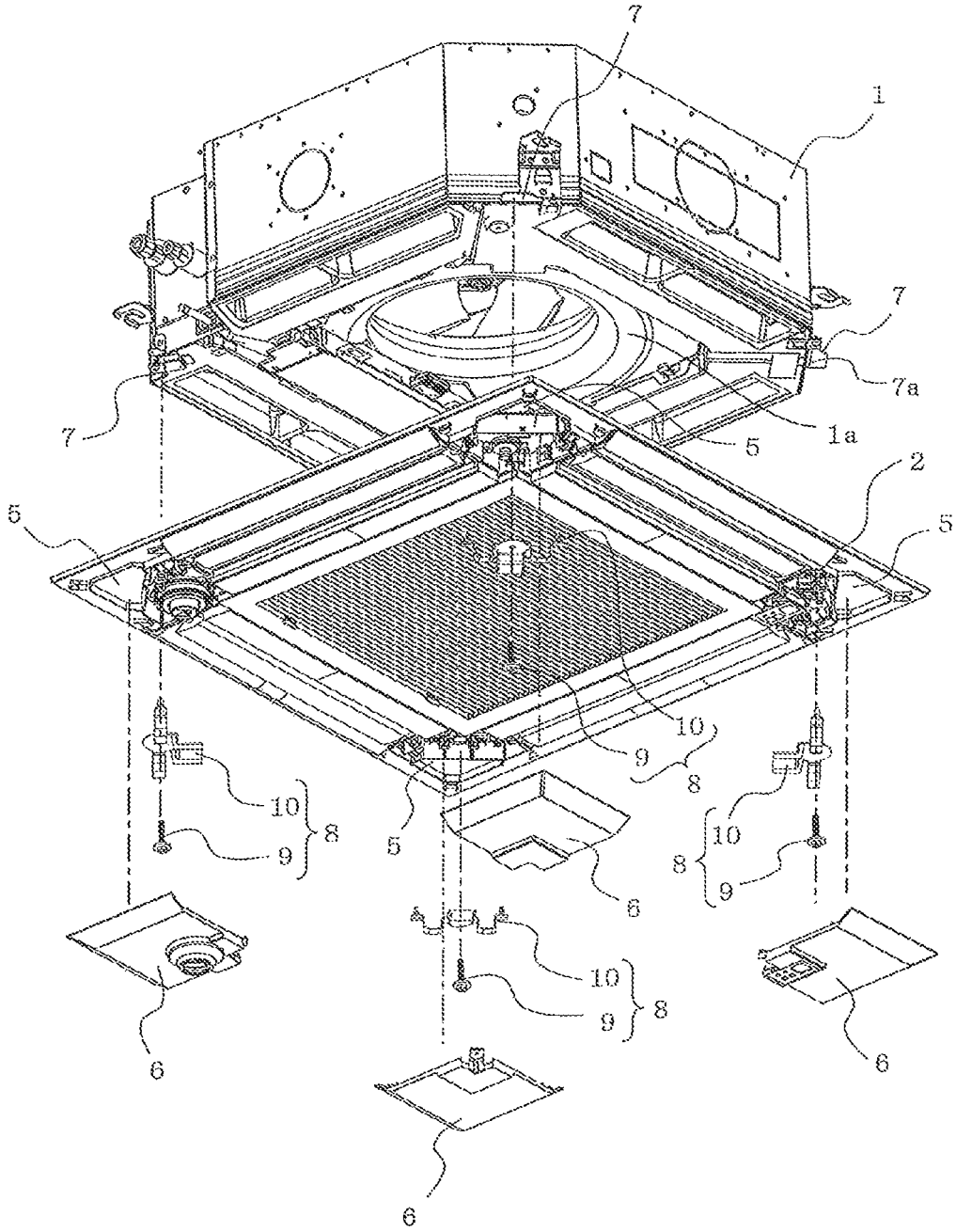
FIG. 2 is an exploded perspective view of the air-conditioning apparatus (indoor unit) according to Embodiment 1 of the present invention.
Figure 3:
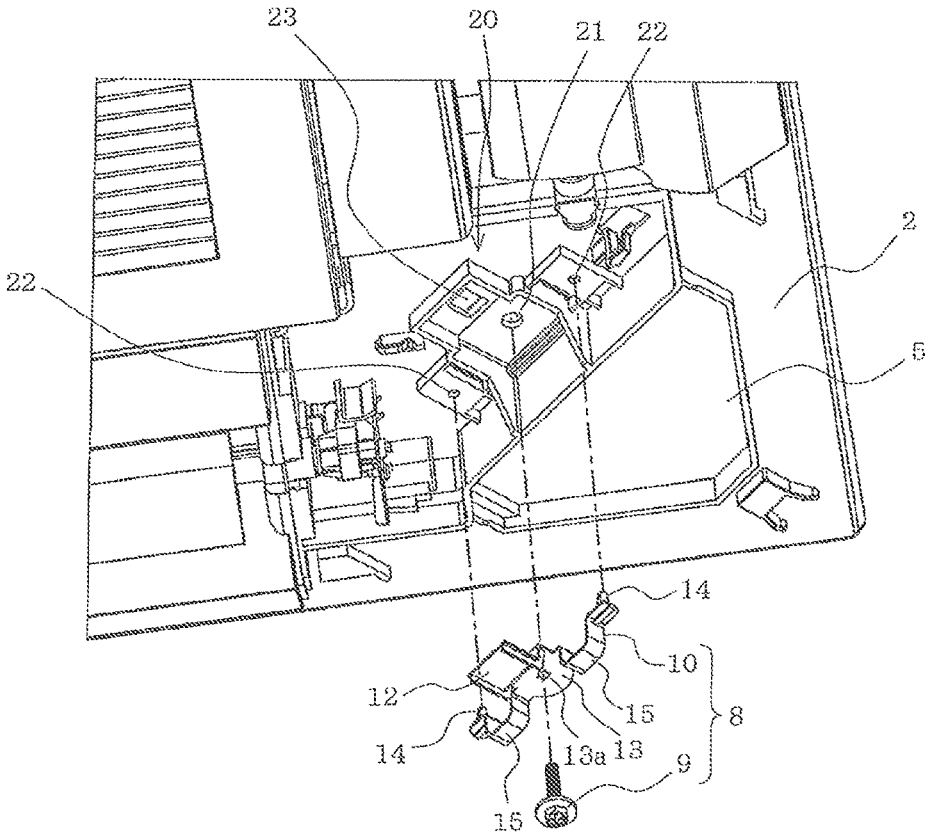
FIG. 3 is an enlarged perspective view of a corner section of a decorative panel 2 of the air-conditioning apparatus (indoor unit) according to Embodiment 1 of the present invention.

FIG. 1 is an appearance perspective view of an air-conditioning apparatus (indoor unit) according to Embodiment 1 of the present invention. FIG. 2 is an exploded perspective view of the air-conditioning apparatus (indoor unit) according to Embodiment 1 of the present invention. FIG. 3 is an enlarged perspective view of a corner section of a decorative panel 2 of the air-conditioning apparatus (indoor unit) according to Embodiment 1 of the present invention. A four-way cassette type air-conditioning apparatus which sends air into a room from four sides will be described herein as an example of the air-conditioning apparatus.

The air-conditioning apparatus is installed on a ceiling of a room with an orientation shown in the figure such that a decorative panel 2 of a substantially rectangular shape is mounted on an opening 1*a* on the underside of an air-conditioning apparatus main body 1. The air-conditioning apparatus main body 1 is disposed on the backside of the ceiling surface and the decorative panel 2 is disposed to be located inside of the room. An air inlet 3 that suctions air into the air-conditioning apparatus main body 1 is disposed at almost center of the decorative panel 2, and an air outlet 4 that blows a conditioned air into the room is disposed around the air inlet 3 along the respective sides (four sides) of the decorative panel 2.

Further, as shown in FIG. 2, operation openings 5 are formed at four corners of the decorative panel 2 and corner panels 6 are removably attached on the operation openings 5. In various operations, the corner panels 6 are removed so that an operator can insert his/her hand or a screw driver through the operation opening 5 for operation.

At four corners of the air-conditioning apparatus main body 1, mount sections 7 are formed to extend outward for mounting of the decorative panel 2. The mount section 7 has a screw fastening hole 7*a* so that a decorative panel mount screw 9 of a mount unit 8, which will be described later, is screwed into the screw fastening hole 7*a*, thereby mounting the decorative panel 2 on the air-conditioning apparatus main body 1. Details of the air-conditioning apparatus main body 1 and a mount structure 2, 8, which includes the decorative panel panel 2, and the mount unit 8, will be described below.

The decorative panel 2 has mount fitting placement sections 20 (see FIG. 3) adjacent to the operation openings 5. The mount fitting placement section 20 has a screw insertion hole 21 through which the decorative panel mount screw 9 is inserted and two claw engagement holes 22 into which two claws 14 of a decorative panel mount fitting 10, which will be described later, are fitted. Each of two claw engagement holes 22 are formed on each side of the screw insertion hole 21. Providing two claw engagement holes 22 facilitates positioning of the decorative panel mount fitting 10 with respect to the decorative panel 2. The mount fitting placement section 20 further includes a small window 23 which is formed by a through hole. The small window 23 allows a distal end of the decorative panel mount screw 9 and a screw fastening hole 7*a* (see FIG. 2) formed on the air-conditioning apparatus main body 1 to be observed from underside of the decorative panel 2 during mounting of the decorative panel 2.

Next, the mount unit 8 for mounting the decorative panel 2 on the air-conditioning apparatus main body 1 will be described in detail. The mount unit 8 is formed of the decorative panel mount screw 9 and the decorative panel mount fitting 10.

Figure 4:
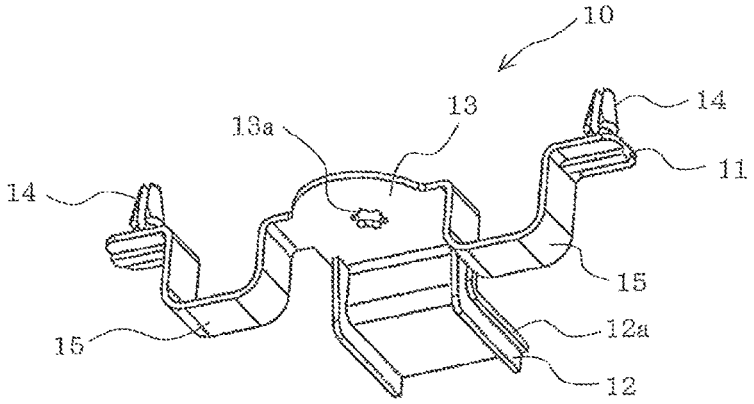
FIG. 4 is an enlarged perspective view of a decorative panel mount fitting 10 of the air-conditioning apparatus (indoor unit) according to Embodiment 1 of the present invention.
Figure 5:
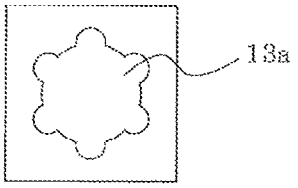
FIG. 5 is a plan view of a screw engagement hole 13*a* of the decorative panel mount fitting 10 of FIG. 2.

FIG. 4 is an enlarged perspective view of the decorative panel mount fitting 10 of the air-conditioning apparatus (indoor unit) according to Embodiment 1 of the present invention. FIG. 5 is a plan view of a screw engagement hole 13*a* of the decorative panel mount fitting 10 of FIG. 2.

The decorative panel mount fitting 10 is made of, for example, a resin material and includes a plate shaped mount section 11 which extends in a longitudinal direction and a cover 12 which is integrally formed with the mount section 11 and extends in a direction perpendicular to the longitudinal direction of the mount section 11 so as to hide a small window 23 of the decorative panel 2. The screw engagement hole 13*a* penetrates the center of the mount section 11 so as to communicate with the screw insertion hole 21 of the decorative panel 2. The screw engagement hole 13*a* has extending portions at spaced positions on the inner peripheral surface and is formed in a star shape so that the distal end of the extending portions press a shaft of the decorative panel mount screw 9, thereby engaging and holding the decorative panel mount screw 9 with the head oriented downward.

Figure 6:
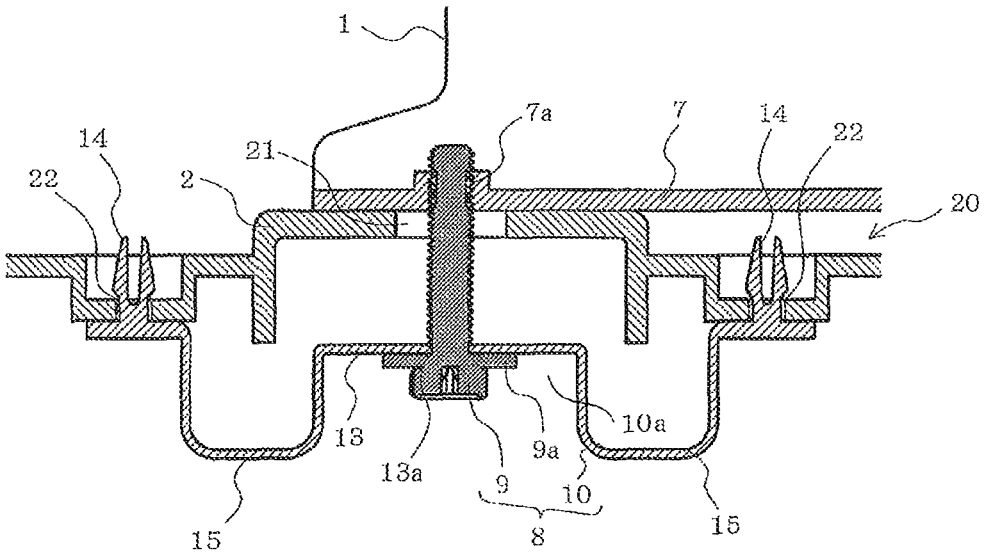
FIG. 6 is a sectional view of the corner section of the decorative panel 2 of the air-conditioning apparatus (indoor unit) according to Embodiment 1 of the present invention, which shows that the decorative panel 2 is temporarily hung on an air-conditioning apparatus main body 1.
Figure 7:
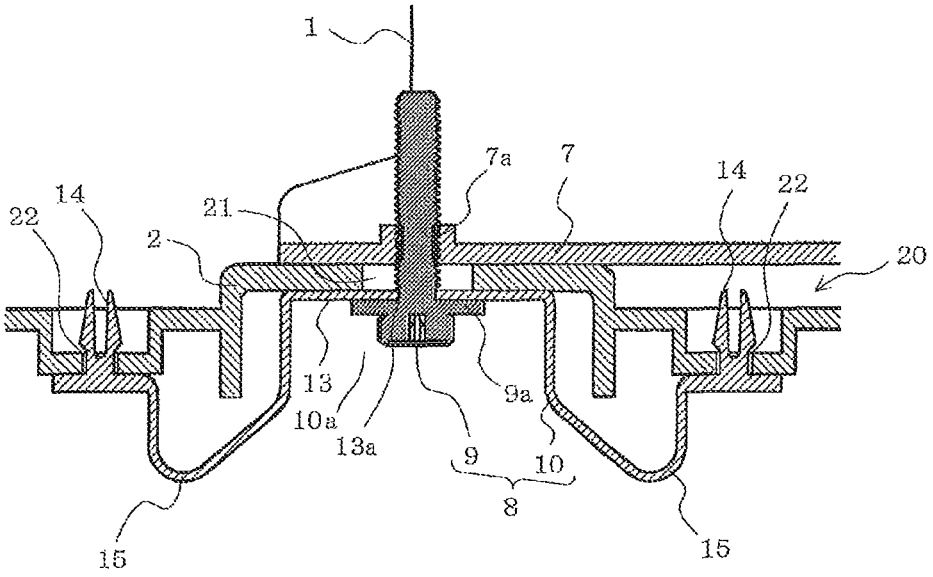
FIG. 7 is a sectional view of the corner section of the decorative panel 2 of the air-conditioning apparatus (indoor unit) according to Embodiment 1 of the present invention, which shows that the decorative panel 2 is mounted on an air-conditioning apparatus main body 1.

The claws 14 which are fitted into the claw engagement holes 22 of the decorative panel 2 are each disposed on each of the ends of the mount section 11 of the decorative panel mount fitting 10. Further, elastically deformable curved sections 15 are disposed between a plate-shaped mount surface section 13 on which the screw engagement hole 13*a* is formed and the claws 14 on both ends of the mount section 11 so that a height position of the mount surface section 13 can be changed by elastic deformation of the curved sections 15. As shown in Figs. 6 and 7, the decorative panel mount fitting 10 forms a recess 10*a* between the curves sections 15, and the mount surface section 13 forms a bottom of the recess 10*a*.

Further, the cover 12 includes a heat insulating material 12*a* on a surface which faces the small window 23, so that the heat insulating material 12*a* closes a gap between the cover 12 and the small window 23 and hides the small window 23. Accordingly, during operation, dew condensation of the air-conditioning apparatus main body 1 and the decorative panel 2 due to air leakage from the small window 23 can be prevented.

Next, a procedure of mounting the decorative panel 2 on the air-conditioning apparatus main body 1 using the decorative panel mount fitting 10 having the above structure will be described.

Figure 8:
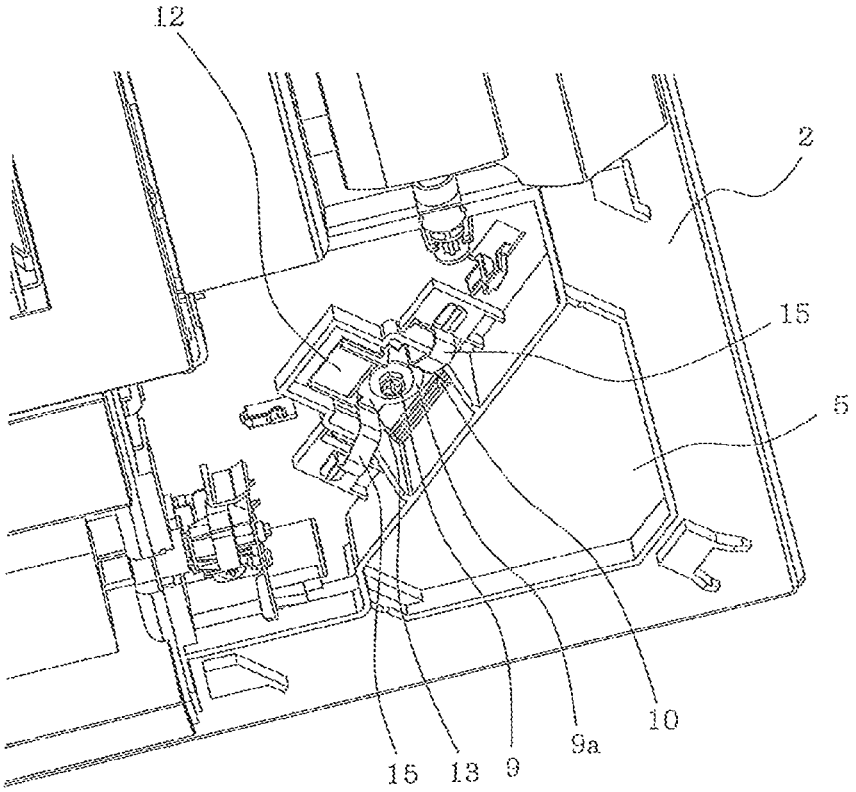
FIG. 8 is an enlarged perspective view of the corner section of the decorative panel 2 of the air-conditioning apparatus (indoor unit) according to Embodiment 1 of the present invention.

FIG. 6 is a sectional view of the corner section of the decorative panel 2 of the air-conditioning apparatus (indoor unit) according to Embodiment 1 of the present invention, which shows that the decorative panel 2 is temporarily hung on an air-conditioning apparatus main body 1. FIG. 7 is a sectional view of the corner section of the decorative panel 2 of the air-conditioning apparatus (indoor unit) according to Embodiment 1 of the present invention, which shows that the decorative panel 2 is mounted on an air-conditioning apparatus main body 1. FIG. 7 shows that each curved section 15 is convexly curved away from the decorative panel, as viewed from below the decorative panel 2, when screwing of the decorative panel mount screw to the screw fastening hole is completed. FIG. 8 is an enlarged perspective view of the corner section of the decorative panel 2 of the air-conditioning apparatus (indoor unit) according to Embodiment 1 of the present invention, which shows that the decorative panel 2 is mounted on an air-conditioning apparatus main body 1.

The mount unit 8 has been assembled to the decorative panel 2 at the time of product shipment. The following explains how the mount unit 8 is assembled. First, after the corner panel 6 is removed, the decorative panel mount fitting 10 is temporarily fixed to the mount fitting placement section 20 of the decorative panel 2. That is, the claws 14 of the decorative panel mount fitting 10 are fitted into the claw engagement holes 22 of the decorative panel 2 while the decorative panel mount screw 9 is engaged with the screw engagement hole 13*a* of the decorative panel mount fitting 10 with the head being oriented downward. Accordingly, the mount unit 8 is engaged with the decorative panel 2 so as not to be dropped off. The same process is done at all the four corners of the decorative panel 2. Thus, the decorative panel mount fittings 10 are temporarily fixed and covered by the corner panels 6 during shipment.

At the installation site of the air-conditioning apparatus, the corner panel 6 is first removed so as to expose the decorative panel mount screw 9 and the decorative panel mount fitting 10 which are temporarily fixed. Then, the decorative panel 2 is temporarily hung on the air-conditioning apparatus main body 1 by an operator of mount operation using an engagement unit, which is not shown in the figure.

In the decorative panel mount fitting 10, the curved section 15 is downwardly flexed and deformed due to a weight of the decorative panel mount screw 9 which is engaged with the screw engagement hole 13*a*. According to the flexure, the mount surface section 13 and the cover 12 are downwardly displaced compared with their positions before the curved section 15 is deformed. Accordingly, a gap is formed between the small window 23 and the cover 12, and the small window 23 can be observed through the gap. Even if the curved section 15 is not flexed by a weight of the decorative panel mount screw 9, a gap is formed between the small window 23 and the cover 12 so that the small window 23 can be observed therethrough.

While the small window 23 is observed through the gap, the distal end of the decorative panel mount screw 9 is aligned with the screw fastening hole 7*a* of the air-conditioning apparatus main body 1 and screwed thereto. As the decorative panel mount screw 9 is rotated and further screwed to the screw fastening hole 7*a*, the curved section 15 of the decorative panel mount fitting 10 is elastically deformed and the mount surface section 13 is moved upward. Since the screw engagement hole 13*a* which is engaged with the decorative panel mount screw 9 has the inner peripheral surface of a star shape as described above, the screw engagement hole 13*a* has a portion having a diameter larger than that of the shaft of the decorative panel mount screw 9. Accordingly, a washer 9*a* is integrally formed with the head of the decorative panel mount screw 9 so that the washer 9*a* can stabilize the position to the decorative panel mount fitting 10 and the mount surface section 13 can be lifted upward with the decorative panel mount screw 9.

When the decorative panel mount screw 9 is screwed to the screw fastening hole 7*a* and the mount surface section 13 abuts against the underside of the mount fitting placement section 20 of the decorative panel 2, the mount operation of the decorative panel 2 is completed.

As described above, according to Embodiment 1, since the mount unit 8 for mounting the decorative panel 2 on the air-conditioning apparatus main body 1 has a two-part structure composed of the decorative panel mount screw 9 and the decorative panel mount fitting 10 which has the screw engagement hole 13*a* that holds the decorative panel mount screw 9 with the head oriented downward and the claws 14 which are fitted into the claw engagement holes 22 of the decorative panel 2 are formed on the decorative panel mount fitting 10 so as to prevent the decorative panel mount fitting 10 from being dropped off from the decorative panel 2, the mount unit 8 can be held on the decorative panel 2. Accordingly, a structure of the mount unit 8 can be simplified with the reduced number of parts, thereby achieving cost reduction.

Further, since the decorative panel mount fitting 10 is held by the decorative panel 2 only by fitting the claws 14 on both ends the decorative panel mount fitting 10 into the claw engagement holes 22 of the decorative panel 2, it provides high assembly workability and service performance. In addition, since the mount unit 8 can be positioned to the decorative panel 2 by fitting two claws 14 and the screw fastening hole 7*a* on the air-conditioning apparatus main body 1 can be easily caught during the mount operation, it also provides high mounting workability.

Further, the decorative panel mount screw 9 does not need to be hand-held during the mount operation of the decorative panel 2 since the mount unit 8 is held by the decorative panel 2 so as not to be dropped off from the decorative panel 2. Accordingly, an operator does not inadvertently drop off the decorative panel mount screw 9 during working at a high place and does not need to climb up and down a stepladder, thereby improving the work efficiency.

Further, since the screw engagement hole 13*a* that temporarily fixes the decorative panel mount screw 9 on the decorative panel mount fitting 10 is formed as a star-shaped hole so that the decorative panel mount screw 9 can be easily inserted and prevented from being easily dropped off, the mounting workability can be improved.

Further, since the small window 23 (through hole) is disposed adjacent to the decorative panel mount screw 9 so that an operator of mount operation can work while observing the distal end of the decorative panel mount screw 9 and the screw fastening hole 7*a* on the air-conditioning apparatus main body 1 from the small window 23, the mounting workability can be improved.

Further, after the decorative panel mount screw 9 is fixed, the small window 23 is covered by the heat insulating material 12*a* of the cover 12 of the decorative panel mount fitting 10 without a gap. Accordingly, during operation, dew condensation of the air-conditioning apparatus main body 1 and the decorative panel 2 due to air leakage from the small window 23 can be prevented.

Further, since the decorative panel mount screw 9 has a common shape, an alternative can be easily prepared even if it is lost or broken, or the threads are worn out at the site. Further, since the decorative panel mount fitting 10 is incorporated into the decorative panel 2 after the installation, it can be repeatedly used during services such as maintenance, which is environmentally friendly.

An engagement structure of the claw 14 is not limited to that shown in the figure, and any structure is possible as long as it can engage and hold the decorative panel mount fitting 10 while preventing it from being dropped off downward.

REFERENCE SIGNS LIST

1 air-conditioning apparatus main body 2 decorative panel 3 air inlet 4 air outlet 5 operation opening 6 corner panel 7 mount section 7*a* screw fastening hole 8 mount unit 9 decorative panel mount screw 9*a* washer 10 decorative panel mount fitting 11 mount section 12 cover 12*a* heat insulating material 13 mount surface section 13*a* screw engagement hole 14 claw 15 curved section 20 mount fitting placement section 21 screw insertion hole 22 claw engagement hole 23 small window

The invention claimed is:

1. An air-conditioning apparatus comprising a decorative panel and mount unit, wherein the mount unit is for mounting the decorative panel on an underside of an air-conditioning apparatus main body, which has an opening, the decorative panel includes a screw insertion hole and a claw engagement hole, wherein the claw engagement hole is formed adjacent to the screw insertion hole, the mount unit is configured to be fitted on an underside of the decorative panel when installed and includes a decorative panel mount fitting, the mount unit has a screw engagement hole, which communicates with the screw insertion hole, a claw, which is fitted into the claw engagement hole, and a decorative panel mount screw, the mount unit is configured to be held by the decorative panel without being dropped when the claw of the decorative panel mount fitting is fitted into the claw engagement hole of the decorative panel, the decorative panel mount screw is engaged with the screw engagement hole of the decorative panel mount fitting with a head of the decorative panel mount screw oriented downward, the decorative panel is configured to be mounted on the air-conditioning apparatus main body when the decorative panel mount screw, which is held on the decorative panel by the decorative panel mount fitting, is screwed into a screw fastening hole of the air-conditioning apparatus main body via the screw insertion hole of the decorative panel body, the decorative panel mount fitting includes a plate-shaped mount surface section in which the screw engagement hole is formed, elastically deformable curved sections are formed on opposite sides of the mount surface section, respectively, between the mount surface section and each of the two claws so that each curved section is elastically deformed, and the mount surface section is displaced upward when the decorative panel mount screw is screwed to the screw fastening hole, the mount surface section abuts against the underside of the decorative panel, each curved section is deformed in a curved shape that is arched outward from the decorative panel when screwing of the decorative panel mount screw to the screw fastening hole is completed, to mount the decorative panel to the air-conditioning apparatus main body, and each curved section is spaced apart from the decorative panel when screwing of the decorative panel mount screw to the screw fastening hole is completed.

2. The air-conditioning apparatus of claim 1, wherein the screw engagement hole of the decorative panel mount fitting is defined by a hole into which a plurality of extending portions radially extend.

3. The air-conditioning apparatus of claim 2, wherein inner ends of the extending portions engage and hold the decorative panel mount screw when the decorative panel mount screw is fitted in the screw engagement hole.

4. The air-conditioning apparatus of claim 1, wherein the decorative panel includes a through hole that allows a distal end of the decorative panel mount screw, which penetrates the screw insertion hole and the screw fastening hole of the air-conditioning apparatus main body, to be observed from below the decorative panel.

5. The air-conditioning apparatus of claim 4, wherein the decorative panel mount fitting includes a cover that covers the through hole from the underside of the decorative panel without a gap.

6. The air-conditioning apparatus of claim 5, wherein the cover of the decorative panel mount fitting includes a heat insulating material that closes a gap between the cover and the through hole in a state in which the decorative panel is mounted on the air-conditioning apparatus main body.

7. An indoor unit comprising the air-conditioning apparatus of claim 1.

8. The air-conditioning apparatus of claim 1, wherein each curved section is arched downward from the mount surface section and away from the decorative panel so that the curved sections are spaced apart from the decorative panel and extend below the head of the decorative panel mount screw when the decorative panel mount screw is fully screwed into the screw fastening hole of the air-conditioning apparatus main body.

9. The air-conditioning apparatus of claim 1, wherein the decorative panel and the mount surface section are held between the head of the decorative panel mount screw and the air-conditioning apparatus main body when the decorative panel mount screw is fully screwed into the screw fastening hole of the air-conditioning apparatus main body.

10. The air-conditioning apparatus of claim 1, wherein the decorative panel mount fitting includes a recess formed between the curved sections, and the mount surface section forms a bottom of the recess, and the head of the decorative panel mount screw is located in the recess when the decorative panel mount screw is fully screwed into the screw fastening hole of the air-conditioning apparatus main body.

11. The air-conditioning apparatus of claim 1, wherein the head of the decorative panel mount screw is located beneath the mount surface section, the mount surface section is located beneath the decorative panel, and the decorative panel is located beneath the air-conditioning apparatus main body when the decorative panel mount screw is fully screwed into the screw fastening hole of the air-conditioning apparatus main body.

12. The air-conditioning apparatus of claim 1, wherein both the head of the decorative panel mount screw and the curved sections are located on a lower side of the decorative panel when the decorative panel is mounted to the air conditioning apparatus main body by the mount unit.

13. The air-conditioning apparatus of claim 1, wherein the mount surface section and the curved sections are integral and continuous parts of the mount unit.

14. The air-conditioning apparatus of claim 1, wherein each curved section is convexly curved away from the decorative panel, as viewed from below the decorative panel, when screwing of the decorative panel mount screw to the screw fastening hole is completed.

* * * * *